United States Patent [19]

Layman, Sr.

[11] 4,398,857

[45] Aug. 16, 1983

[54] SELF-FEEDING APPLIANCE

[76] Inventor: Frank D. Layman, Sr., 720 N. McKown, Sherman, Tex. 75090

[21] Appl. No.: 323,741

[22] Filed: Nov. 23, 1981

[51] Int. Cl.[3] ..... A47G 21/00; A47G 19/30; A47G 23/08

[52] U.S. Cl. ..... 414/9; 604/77

[58] Field of Search ..... 414/9; 604/77, 57

[56] References Cited

U.S. PATENT DOCUMENTS

| | | | |
|---|---|---|---|
| D. 231,302 | 4/1974 | Lukawski et al. | D7/17 |
| 3,162,475 | 12/1964 | Van Allen | 294/26 |
| 3,228,536 | 1/1966 | Gratzer | 414/9 |
| 3,254,444 | 6/1966 | Paterson | 46/228 |
| 3,317,061 | 5/1967 | Causey | 414/9 |
| 3,734,306 | 5/1973 | Morewood | 214/1 T |
| 3,885,681 | 5/1975 | Mancino | 214/1 T |
| 3,907,126 | 9/1975 | Sydnor, Sr. | 414/9 |
| 4,162,868 | 7/1979 | Stapleton et al. | 414/9 |
| 4,364,699 | 12/1982 | Koppes | 414/9 |

*Primary Examiner*—Robert J. Spar
*Assistant Examiner*—Janice Krizek
*Attorney, Agent, or Firm*—Dennis T. Griggs

[57] ABSTRACT

A self-feeding appliance for use by persons who have lost the use of both arms is disclosed. A turntable carrying one or more food dishes is mounted for rotation on a carriage panel. The carriage panel is mounted on a service platform for movement from a retracted position overlying a service deck portion of the service platform to an extended position forward of the service deck. A spoon is mounted on the carriage panel and projects laterally over the service deck. The lateral position of the spoon and the elevation of the service platform is adjustable to accomodate wheel chair service, bedside service, or table service. After the appliance is set up on a bed tray or on a table, a food dish is selected by rotating the turntable until the selected dish is brought into alignment with the spoon. This is accomplished entirely by head and neck movements, in conjunction with minimal upper torso control, by manipulating a scraping utensil secured to a headband, whereby a disabled person can select and eat food without assistance or supervision.

1 Claim, 2 Drawing Figures

SELF-FEEDING APPLIANCE

BACKGROUND OF THE INVENTION

1. Field of the Invention

This invention relates generally to self-feeding appliances for functionally disabled persons, and in particular to a self-feeding appliance which can be operated independently and without assistance or supervision by a person having head and neck movement control and minimal upper torso control.

2. Description of the Prior Art

Persons suffering extreme functional disabilty as a result of disease or trauma may be temporarily or permanently unable to perform acts of independent living which require motor control over functional upper extremity movement. Such disabilites, including extensive paralysis, may occur as a result of poliomyelitis, muscular distrophy, cerebral palsy, spinal cord lesions, Thalidomide effects, congenital deformities such as arthrogryposis, and bilateral above-the-elbow amputations. Generally, although such persons may lack functional control in their upper extremities, some degree of normal muscular control of upper torso and shoulder movement is retained including control over head and neck movements.

Various mechanical devices have been proposed for use by such disabled persons which initiate a fully automated sequence for performing a simple task. Widespread acceptance of such devices has been limited because of cost, complexity, training and supervision requirements. There is, therefore, a continuing interest in providing appliances which provide some degree of personal independence, instills confidence, develops residual limb function, and generally enhances rehabilitation.

OBJECTS OF THE INVENTION

A general object of the present invention is to provide a person having extreme functional disability with means for developing immediate confidence and independence in the act of selecting and eating food without assistance or supervision.

A specific object of the present invention is to provide a self-feeding appliance which is capable of being operated by head and neck movements.

A related object of the invention is to provide a self-feeding appliance which is simple, inexpensive and which can be operated with minimal effort, concentration and training.

Another object of the invention is to provide a self-feeding appliance which is portable, easy to operate and which can easily be disassembled for cleaning.

Yet another object of the present invention is to provide a self-feeding appliance for use by functionally handicapped persons which can be operated entirely by head and neck movements, in conjunction with minimal upper torso control, to select a food portion from a dish and collect it in a spoon.

SUMMARY OF THE INVENTION

A self-feeding appliance for use by persons who have lost the use of both arms is disclosed. A turntable carrying one or more food dishes is mounted for rotation on a carriage panel. The carriage panel is mounted on a service platform for movement from a retracted position overlying a service deck portion of the service platform to an extended position forward of the service deck. A spoon is mounted on the carriage panel and projects laterally over the service deck. The lateral position of the spoon and the elevation of the service platform is adjustable to accomodate wheel chair service, bedside service and table service.

After the appliance is set up on a bed tray or on a table, a food dish is selected by rotating the turntable until the selected dish is in alignment with the spoon. This is accomplished entirely by head and neck movement, in conjunction with minimal upper torso control by manipulating a scraping utensil secured to a headband, whereby a disabled person can select and eat food without assistance or supervision.

The spoon preferably includes an open channel member which slopes downwardly from a point near the lip of the dish, with a lower open end overlying the spoon for guiding food scraped from the dish into the spoon. The spoon and channel member are preferably constructed as a single unit, which is removable from the carriage panel to facilitate cleaning.

Turn knobs are attached at symmetrically spaced locations on the top of the turntable between dishes. The turntable is rotated by pulling the turn knob with the scraping utensil until the desired dish is aligned with the channel member and spoon.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DESCRIPTION OF THE PREFERRED EMBODIMENT

Figure 1:
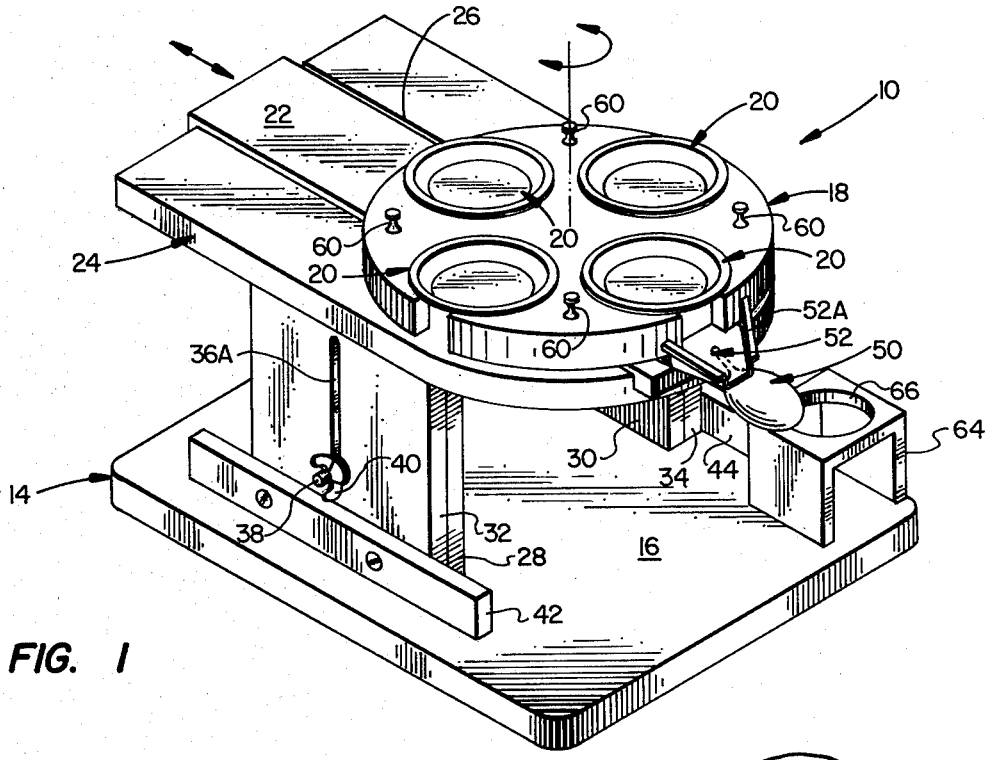
FIG. 1 is a perspective view of a self-feeding appliance.

In the description which follows, like parts are marked throughout the specification and drawings with the same reference numerals, respectively. The drawings are not necessarily to scale, and in some instances, portions have been exaggerated in order to more clearly depict certain features of the invention.

Figure 2:
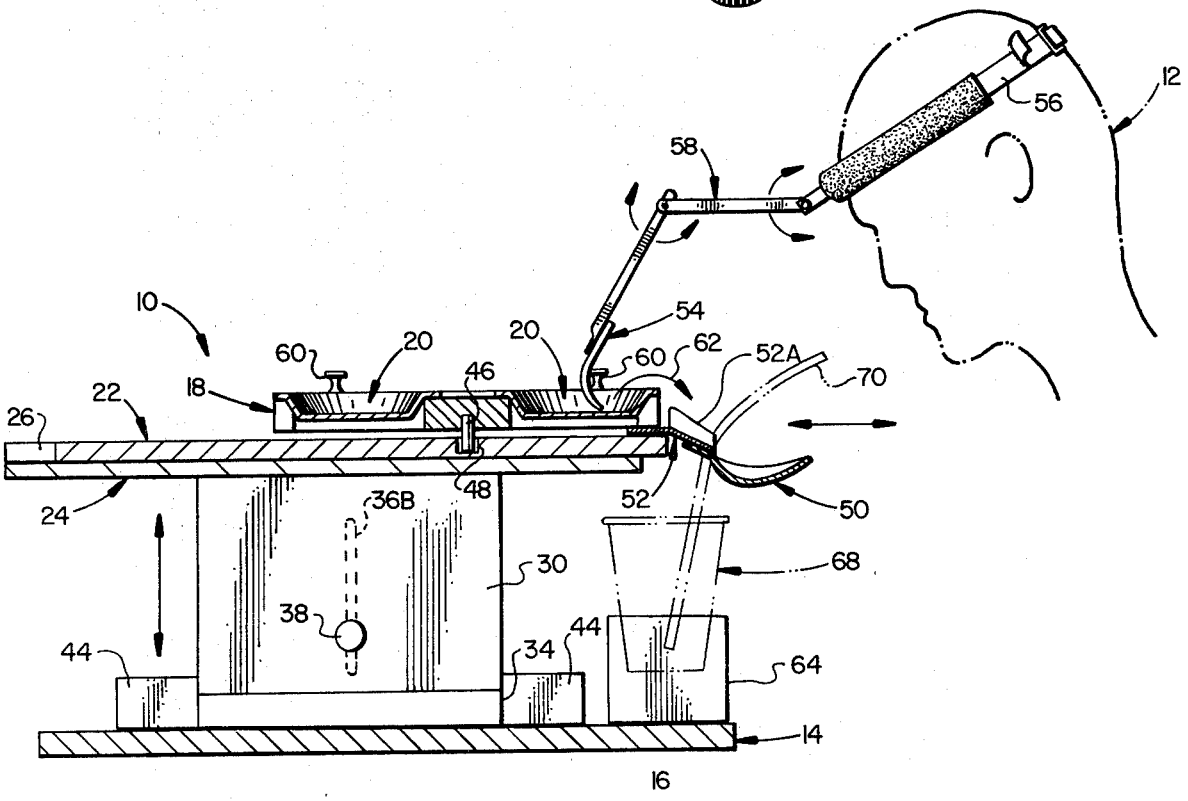
FIG. 2 is an elevation view, partly in section, which illustrates typical operation of the self-feeding appliance.

Referring now to FIGS. 1 and 2, a self-feeding appliance 10 is provided for use by a functionally disabled person 12 who does not have use of his arms, but does have control over head and neck movements and some degree of muscular control over upper torso movement. The self-feeding appliance 10 is designed to be operated by the disabled person 12 solely by head, neck and torso movements to provide independence in the act of selecting and eating food without assistance or supervision.

The self-feeding appliance 10 includes a support platform 14 having a service deck 16. The purpose of the support platform is to provide a stable support base for the appliance when placed on a table or bed tray.

A turntable 18 carrying one or more food dishes 20 is mounted for rotation on a carriage panel 22. The carriage panel 22 is slidably mounted on a service platform 24 for movement from a retracted position, as illustrated in FIG. 1, to an extended position forward of the service desk 16, as illustrated in FIG. 2. If desired, the carriage panel 22 can be lifted from the slip channel 26 and completely removed from the appliance assembly 10.

The service platform 24 is supported in a stable, horizontal position in parallel with the support platform 14 by upright support blocks 28, 30. The support blocks 28, 30 are stabilized by stabilizer blocks 32, 34 respectively. The stabilizer blocks 32, 34 are each intersected by a vertical slot 36A, 36B, respectively, through which a threaded fastener 38 projects. The threaded fastener 38 extends completely through each support block and stabilizer block pair, whereby the service platform 24 can be raised and lowered in elevation and secured in place after the desired elevation has been selected. Each threaded fastener 38 is tightened by a wing nut 40. The support blocks are further stabilized by horizontal strips 42, 44, respectively.

The turntable 18 is rotatably coupled to the carriage panel 22 by a rotor shaft 46. The rotor shaft 46 is firmly attached to the turntable 18, and is loosely received within a bearing cup 48 to permit free rotation of the turntable 18. Preferably, the turntable 18 drags across the surface of the service platform 24 so that the frictional engagement of the turntable tends to maintain the turntable in place once a selected dish has been moved into the service position.

Attached to the service end of the carriage panel 22 is a spoon 50 and open channel member 52. The spoon 50 projects laterally over the service deck area at an elevation approximately equal to the elevation of the service platform 24. The open channel member 52 slopes generally from the lip region of the dish 20 downwardly to a position overlying the spoon 50 for guiding food scraped from the dish 20 into the spoon. The channel member 52 is open from end to end whereby food can be scraped directly from the dish 20 onto the channel member and from the channel member directly into the spoon. The channel member 52 is preferably provided with upturned flange sidewalls 52A to minimize food spillage. The spoon 50 and channel member 52 are preferably constructed as a single unit, and is removable attached to the service end of the carriage panel 22 to facilitate cleaning.

After the dishes 20 are filled with food, the appliance 10 is set up on a bed tray or on a table, and a food dish is selected by rotating the turntable 18 until the selected dish 20 is in general alignment with the spoon 50 and channel member 52. This is accomplished entirely by head and neck movements, in conjunction with minimal upper torso movement, by manipulating a scraping utensil 54 which is secured to a headband 56 through an adjustable linkage 58. Turn knobs 60 projecting from the top surface of the turntable 18 are engaged by the scraper utensil 54 and are pulled toward the disabled person by appropriate head and torso movements until the selected dish is brought into alignment with the service position. Thereafter, the disabled person scrapes the desired portion of food into the channel member 52 and spoon 50 as indicated by the arrow 62. After the spoon 50 is filled with food, the disabled person bends forward to receive the food from the spoon in the usual manner. This process is repeated by the disabled person, without assistance or supervision, until the meal has been completed.

A cup support 64 is secured to one side of the service deck 16 and is provided with a circular opening 66 for receiving a beverage container 68. The beverage can easily be consumed through a straw 70 without risk of tipping over the container.

Although perferred embodiments of the invention have been described in detail, it should be understood that various changes, alterations and substitutions can be made therein without departing from the spirit and scope of the invention as defined by the appended claims.

What is claimed is:

1. A self-feeding appliance for use by persons who have lost the use of both arms comprising, in combination:

a support platform having a service deck;

a service platform movably mounted for vertical displacement in elevation above said support platform;

a carriage panel mounted on said service platform for movement from a retracted position overlying said service deck to an extended position forward the service deck;

a spoon mounted on said carriage panel and projecting laterally over said service deck;

a turntable mounted for rotation on said carriage panel;

a food dish carried by said turntable; and, an open channel member mounted on said carriage panel having an elevated open end adjacent said turntable and a lower open end overlying said spoon for guiding food scraped from said dish into said spoon.

* * * * *